US006604244B1

(12) United States Patent
Leach

(10) Patent No.: US 6,604,244 B1
(45) Date of Patent: Aug. 12, 2003

(54) WORK GLOVE

(76) Inventor: Curtiss B. Leach, 3047 N. Oakland, Milwaukee, WI (US) 53211

( * ) Notice: Subject to any disclaimer, the term of this patent is extended or adjusted under 35 U.S.C. 154(b) by 0 days.

(21) Appl. No.: 10/158,947

(22) Filed: May 31, 2002

(51) Int. Cl.[7] ..... A41D 19/00
(52) U.S. Cl. ..... 2/161.6; 2/160; 15/227
(58) Field of Search ..... 2/160, 161.1, 162, 2/170, 161.6, 161.4, 161.7, 917; 15/227

(56) References Cited

U.S. PATENT DOCUMENTS

| | | | | | |
|---|---|---|---|---|---|
| 3,643,386 | A | | 2/1972 | Grzyll | |
| 4,038,787 | A | * | 8/1977 | Bianchi | 451/523 |
| 4,107,840 | A | * | 8/1978 | Kupperman et al. | 30/172 |
| D268,968 | S | | 5/1983 | Sami | |
| 4,621,388 | A | * | 11/1986 | Ortolivo | 15/227 |
| 5,419,014 | A | | 5/1995 | Piantedosi | |
| D365,896 | S | | 1/1996 | Zuege | |
| 5,682,837 | A | * | 11/1997 | Courtney et al. | 119/625 |
| 5,809,570 | A | * | 9/1998 | Grover | 2/161.1 |
| 5,956,770 | A | | 9/1999 | Dennis | |
| 6,016,571 | A | * | 1/2000 | Guzman et al. | 2/167 |
| 6,018,837 | A | * | 2/2000 | Andreu | 15/118 |
| 6,098,234 | A | * | 8/2000 | Jackson, Jr. | 15/118 |

* cited by examiner

*Primary Examiner*—John J. Calvert
*Assistant Examiner*—Katherine Moran

(57) ABSTRACT

A work glove for multi-purpose uses is disclosed herein. The work glove includes at least one glove member for positioning on a hand of a user. The glove member includes a wrist portion, a palm portion, and a plurality of digit portions. The glove member has a front surface and a back surface. A plurality of hook and loop fasteners sections are fixedly coupled to the front surface of the glove member. The hook and loop fastener sections include a palm fastener section and a plurality of digit fastener sections. A plurality of pads releasably attaches to the hook and loop fastener sections. The plurality of pads comprises a palm pad and a plurality of digit pads for selectively coupling to the palm fastener section and the digit fastener sections respectively. A fastening apparatus secures the glove member to the hand of the user.

12 Claims, 3 Drawing Sheets

WORK GLOVE

BACKGROUND OF THE INVENTION

1. Field of the Invention

The present invention relates to work gloves and more particularly pertains to a new work glove for multi-purpose uses.

2. Description of the Prior Art

The use of work gloves is known in the prior art. U.S. Pat. No. 5,956,770 describes a glove with attachable cleaning pads. Another type of work glove is U.S. Pat. No. 3,643,386 discloses an abrasive hand apparel.

While these devices fulfill their respective, particular objectives and requirements, the need remains for a work glove that is more universal with regards to the applications it can be utilized for, and allows the user to work tight areas.

SUMMARY OF THE INVENTION

The present invention meets the needs presented above by the utilization of removable pads having a variety of work surfaces that are attachable to both the palm portion and the fingertips.

Still yet another object of the present invention is to provide a new work glove that protects hands and fingers from the abrasive action of steel wool or sandpaper and from harsh chemical products and the drying effect of water.

Even still another object of the present invention is to provide a new work glove that eliminates the problem of dropping steel wool pads, sandpaper, sponges, and other cleaning aids.

To this end, the present invention generally comprises at least one glove member for positioning on a hand of a user. The glove member includes a wrist portion, a palm portion, and a plurality of digit portions. The glove member has a front surface and a back surface. A plurality of hook and loop fasteners sections are fixedly coupled to the front surface of the glove member. The hook and loop fastener sections include a palm fastener section and a plurality of digit fastener sections. A plurality of pads releasably attaches to the hook and loop fastener sections. The plurality of pads comprises a palm pad and a plurality of digit pads for selectively coupling to the palm fastener section and the digit fastener sections respectively. A fastening apparatus secures the glove member to the hand of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
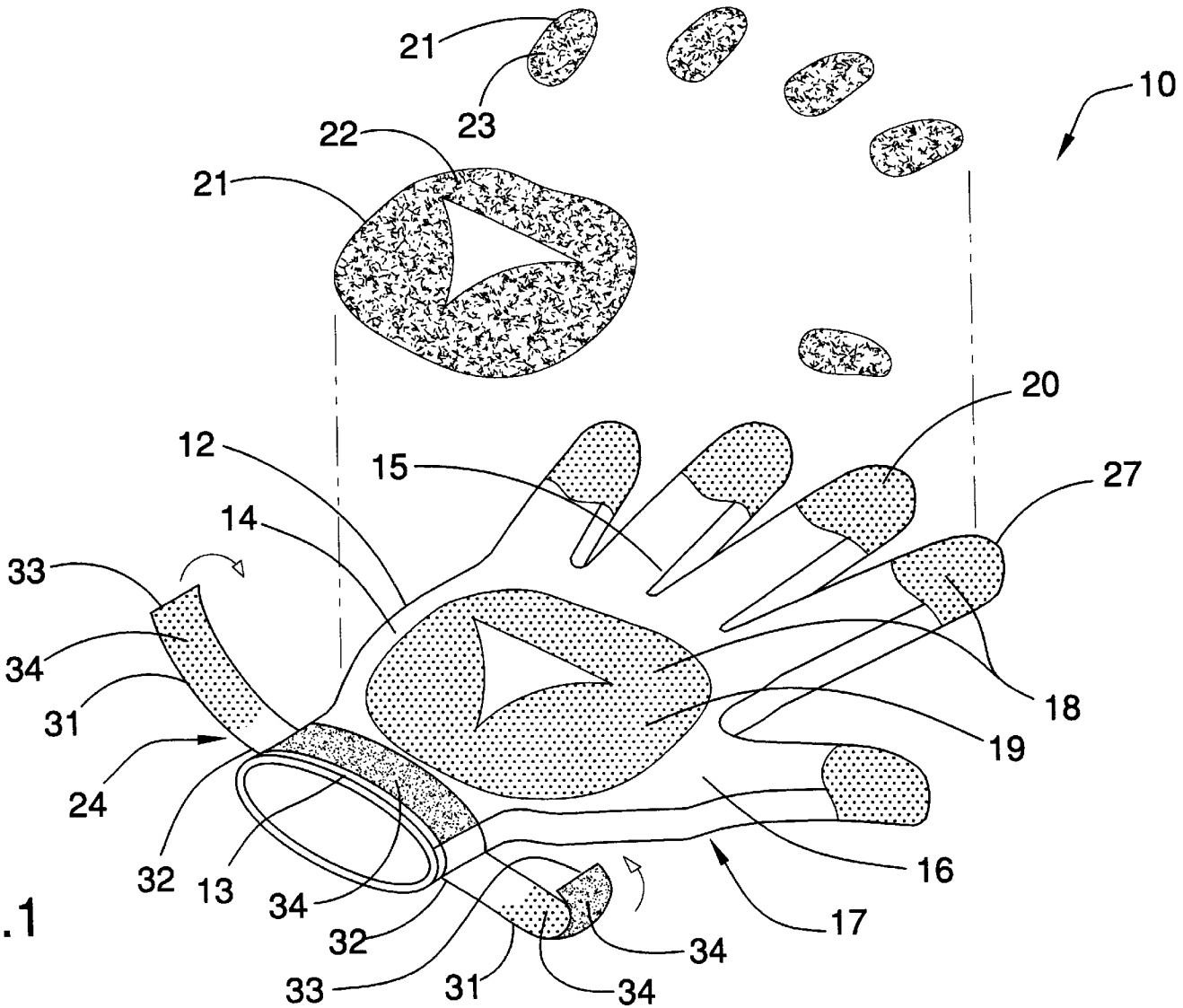
FIG. 1 is a schematic perspective view of a new work glove according to the present invention.
Figure 2:
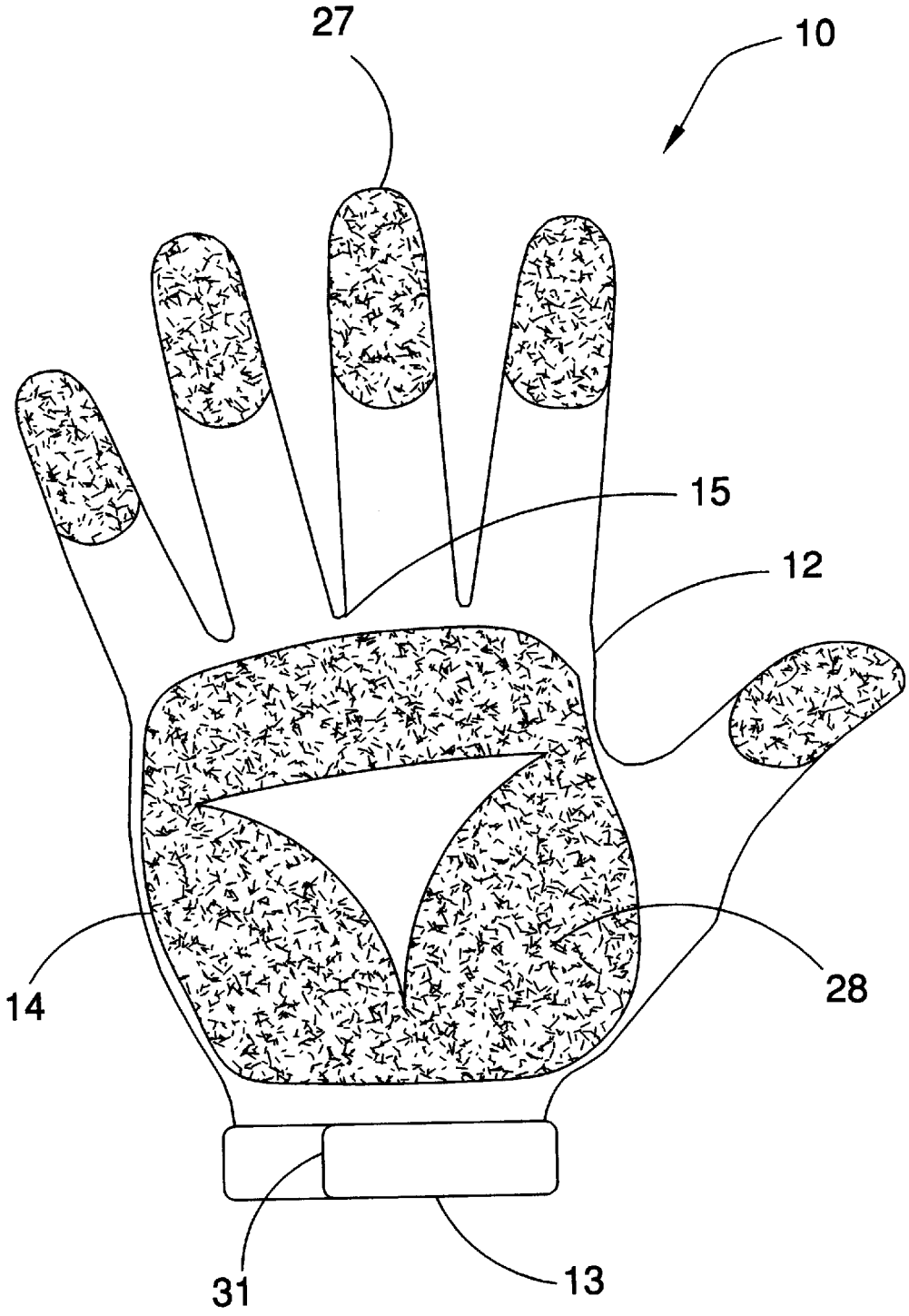
FIG. 2 is a schematic front view of the present invention with the pads attached.
Figure 3:
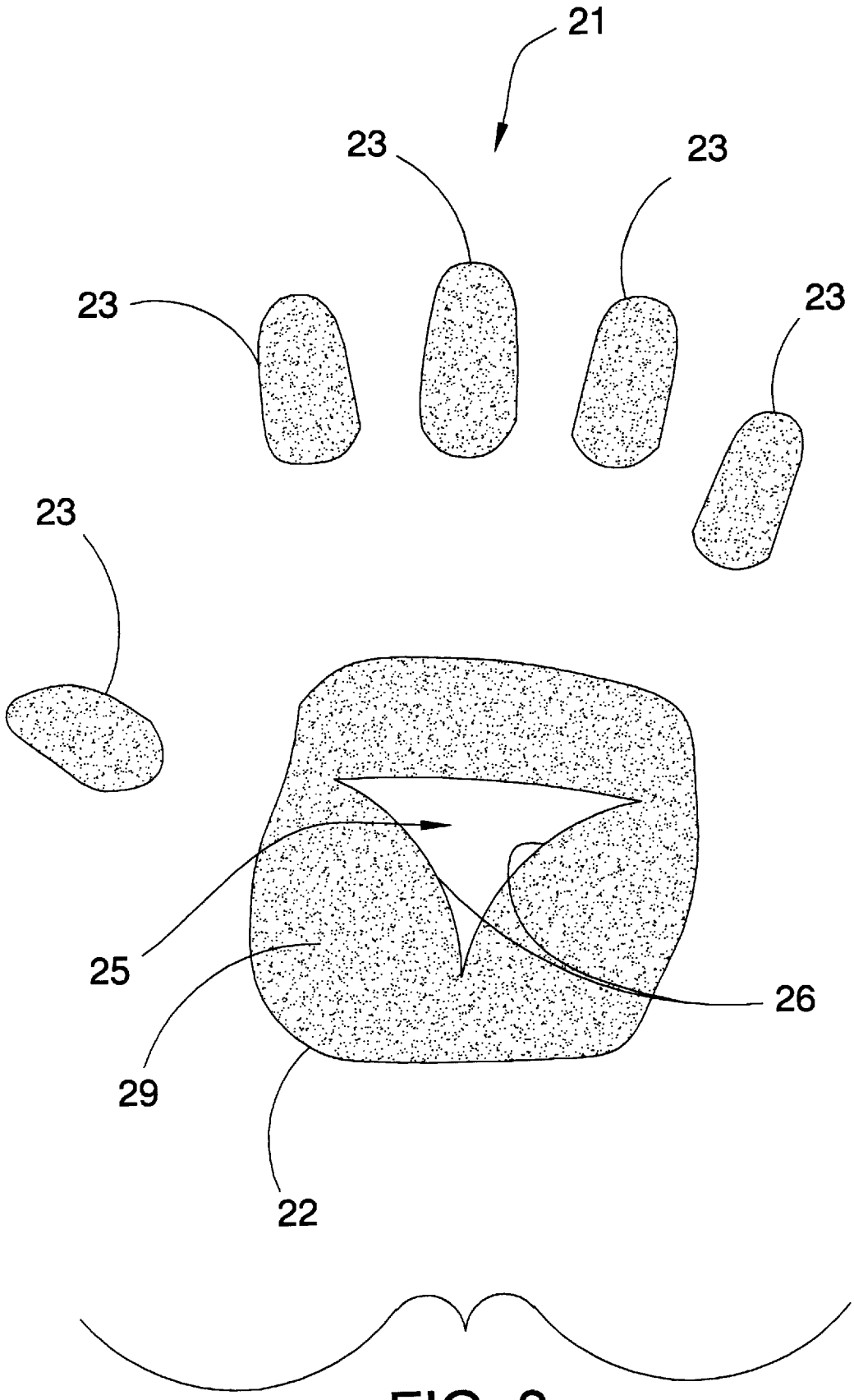
FIG. 3 is a schematic top view of the attachment side of the pads of the present invention.

With reference now to the drawings, and in particular to FIGS. 1 through 3 thereof, a new work glove embodying the principles and concepts of the present invention and generally designated by the reference numeral 10 will be described.

As best illustrated in FIGS. 1 through 3, the work glove 10 generally comprises at least one glove member 12 for positioning on a hand of a user. The glove member 12 comprises a fitted covering for the hand having a sheath for each finger and the thumb. The glove member 12 includes a wrist portion 13, a palm portion 14, and a plurality of digit portions 15. The glove member 12 has a front surface 16 and a back surface 17.

A plurality of hook and loop fastener sections 18 are fixedly coupled to the front surface 16 of the glove member 12. The hook and loop fastener sections 18 include a palm fastener section 19 and a plurality of digit fastener sections 20.

A plurality of pads 21 releasably attaches to the hook and loop fastener sections 18. The plurality of pads 21 comprises a palm pad 22 and a plurality of digit pads 23 for selectively coupling to the palm fastener section 19 and the digit fastener sections 20 respectively.

A fastening apparatus 24 secures the glove member 12 to the hand of the user.

The glove member 12 comprises a resiliently elastomeric material, most preferably neoprene.

The palm fastener section 19 is mounted on the front surface 16 of the palm portion 14 of the glove member 12. The palm fastener section 19 extends across a width of the palm portion 14 and extends between the digit portions 15 and the wrist portion 13.

The palm fastener section 19 includes a cutout portion 25 for increasing the flexibility of the palm fastener section 19. The cutout portion 25 is generally triangular and has a pair of opposing concave inside edges 26 for conforming to the hand of the user when flexed.

Each of the digit fastener sections 20 are mounted on the front surface 16 of a respective one of the digit portions 15 of the glove member 12 and extends from a tip 27 of the digit portions 15 towards the palm portion 14 a distance generally equal to a last part of a finger of the user such that a degree of bending motion of the finger is restricted only by the glove member 12.

The digit fastener sections 20 extend beyond the front surface 16 to the back surface 17 such that opposite sides and the tip 27 of each of the digit portions 15 include a hook and loop fastener.

Each of the pads 21 has a working side 28 and an attaching side 29. The attaching side 29 of each of the pads 21 comprises a mating hook and loop fastener for permitting the user to releasably attach the pads 21 to the glove member 12.

Each of the fastener sections are dimensioned substantially coextensive with a respective one of each of the pads 21 such that each of the digit pads 23 is positionable about a large portion of fingertips 27 of the user thereby permitting the user to access tighter areas while working.

The working side 28 of each of the pads 21 is selected from the group consisting of a sponge, steel wool, and sandpaper.

The fastening apparatus 24 comprises a pair of coupling straps 31. Each of the straps has a first end 32 attached to the back surface 17 of the wrist portion 13 of the glove member 12, and a free end 33 that is selectively couplable to the front surface 16 of the wrist portion 13. Each of the straps and the front surface 16 of the wrist portion 13 has hook and loop fasteners 34 permitting the user to attach each of the straps to the wrist portion 13 for the purpose of tightening the wrist portion 13 about a wrist of the user when the glove member 12 is positioned on the hand of the user to restrict the glove member 12 from releasing from the hand during use.

In use, the user would choose which of the type of pads 21 is appropriate for the task at hand, attach each of the pads 21 to the associated fastener sections 19, 20 on the glove member 12 and begin work. Upon completion of the work, the pads 21 are removed from the glove member 12 and cleaned or disposed of as necessary.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A work glove comprising:

at least one glove member for positioning on a hand of a user, said glove member comprising a fitted covering for the hand having a sheath for each finger and the thumb, said glove member including a wrist portion, a palm portion, and a plurality of digit portions, said glove member having a front surface and a back surface;

a plurality of hook and loop fastener sections being fixedly coupled to said front surface of said glove member, wherein said hook and loop fastener sections include a palm fastener section and a plurality of digit fastener sections;

a plurality of pads for releasably attaching to said hook and loop fastener sections, said plurality of pads comprising a palm pad and a plurality of digit pads for selectively coupling to said palm fastener section and said digit fastener sections respectively;

a fastening apparatus for securing said glove member to the hand of the user; and said palm fastener section including a cutout portion for increasing the flexibility of said palm fastener section, said cutout portion being generally triangular and having a pair of opposing concave inside edges for conforming to the hand of the user when flexed.

2. The work glove as set forth in claim 1, wherein said glove member comprises a resiliently elastomeric material.

3. The work glove as set forth in claim 1, wherein said glove member comprises neoprene.

4. The work glove as set forth in claim 1, further comprising said palm fastener section being mounted on said front surface of said palm portion of said glove member, said palm fastener section extending across a width of said palm portion and extending between said digit portions and said wrist portion.

5. The work glove as set forth in claim 1, further comprising each of said digit fastener sections being mounted on said front surface of a respective one of said digit portions of said glove member and extends from a tip of said digit portions towards said palm portion a distance generally equal to a last part of a finger of the user such that a degree of bending motion of the finger is restricted only by said glove member.

6. The work glove as set forth in claim 5, wherein said digit fastener sections extends beyond said front surface to said back surface such that opposite sides and said tip of each of said digit portions include a hook and loop fastener.

7. The work glove as set forth in claim 1, further comprising each of said pads having a working side and an attaching side, said attaching side of each of said pads comprising a mating hook and loop fastener for permitting the user to releasably attach said pads to said glove member.

8. The work glove as set forth in claim 1, further comprising each of said fastener sections being dimensioned substantially coextensive with a respective one of each of said pads such that each of said digit pads is positionable about a large portion of fingertips of the user thereby permitting the user to access tighter areas while working.

9. The work glove as set forth in claim 7, further comprising said working side of each of said pads being selected from the group consisting of a sponge, steel wool, and sandpaper.

10. The work glove as set forth in claim 1, further comprising said fastening apparatus comprising a pair of coupling straps, each of said straps having a first end attached to said back surface of said wrist portion of said glove member and a free end being selectively couplable to said front surface of said wrist portion.

11. The work glove as set forth in claim 10, wherein each of said straps and said front surface of said wrist portion has hook and loop fasteners permitting the user to attach each of said straps to said wrist portion for the purpose of tightening said wrist portion about a wrist of the user when said glove member is positioned on the hand of the user to restrict the glove member from releasing from the hand during use.

12. A work glove comprising:

at least one glove member for positioning on a hand of a user, said glove member comprising a fitted covering for the hand having a sheath for each finger and the thumb, said glove member including a wrist portion, a palm portion, and a plurality of digit portions, said glove member having a front surface and a back surface;

a plurality of hook and loop fastener sections being fixedly coupled to said front surface of said glove member, wherein said hook and loop fastener sections include a palm fastener section and a plurality of digit fastener sections;

a plurality of pads for releasably attaching to said hook and loop fastener sections, said plurality of pads comprising a palm pad and a plurality of digit pads for selectively coupling to said palm fastener section and said digit fastener sections respectively;

a fastening apparatus for securing said glove member to the hand of the user;

wherein said glove member comprises a resiliently elastomeric material;

wherein said glove member comprises neoprene;

said palm fastener section being mounted on said front surface of said palm portion of said glove member, said palm fastener section extending across a width of said palm portion and extending between said digit portions and said wrist portion;

said palm fastener section including a cutout portion for increasing the flexibility of said palm fastener section, said cutout portion being generally triangular and having a pair of opposing concave inside edges for conforming to the hand of the user when flexed;

each of said digit fastener sections being mounted on said front surface of a respective one of said digit portions of said glove member and extends from a tip of said digit portions towards said palm portion a distance generally equal to a last part of a finger of the user such that a degree of bending motion of the finger is restricted only by said glove member;

wherein said digit fastener sections extends beyond said front surface to said back surface such that opposite sides and said tip of each of said digit portions include a hook and loop fastener;

each of said pads having a working side and an attaching side, said attaching side of each of said pads comprising a mating hook and loop fastener for permitting the user to releasably attach said pads to said glove member;

each of said fastener sections being dimensioned substantially coextensive with a respective one of each of said pads such that each of said digit pads is positionable about a large portion of fingertips of the user thereby permitting the user to access tighter areas while working;

said working side of each of said pads being selected from the group consisting of a sponge, steel wool, and sandpaper;

said fastening apparatus comprising a pair of coupling straps, each of said straps having a first end attached to said back surface of said wrist portion of said glove member and a free end being selectively couplable to said front surface of said wrist portion; and wherein each of said straps and said front surface of said wrist portion having hook and loop fasteners permitting the user to attach each of said straps to said wrist portion for the purpose of tightening said wrist portion about a wrist of the user when said glove member is positioned on the hand of the user to restrict the glove member from releasing from the hand during use.

* * * * *